US006117239A

United States Patent [19]

Spinosa

[11] Patent Number: 6,117,239

[45] Date of Patent: Sep. 12, 2000

[54] APPARATUS FOR TRIMMING OF EDGES

[76] Inventor: Dan Spinosa, P.O. Box 252, Lynnfield, Mass. 01940

[21] Appl. No.: 08/962,591

[22] Filed: Oct. 31, 1997

[51] Int. Cl.[7] ..... B05C 17/00

[52] U.S. Cl. ..... 118/507; 118/505

[58] Field of Search ..... 118/504, 505; 427/282; 15/257.01, 257.05; 294/3.5; 206/1.7, 1.8, 1.9, 564; 220/755, 771, 769, 768

[56] References Cited

U.S. PATENT DOCUMENTS

| | | | |
|---|---|---|---|
| 456,775 | 7/1891 | Prescott | 15/257.01 |
| 2,167,699 | 8/1939 | Weesner | 118/504 |
| 2,693,785 | 11/1954 | West, Jr. | 118/504 |
| 2,821,078 | 1/1958 | Steward . | |
| 4,142,627 | 3/1979 | Szegi | 206/1.7 |
| 4,325,323 | 4/1982 | Rioux | 118/504 |
| 4,536,913 | 8/1985 | Morawski | 118/504 |

*Primary Examiner*—Laura Edwards
*Attorney, Agent, or Firm*—G. E. Kersey

[57] ABSTRACT

Facilitation of the trimming of edges by apparatus formed by a multi-sided member having a surface with a reservoir thereon that forms an opened pocket affixed to the surface, with the pocket having a base to which a handle is connected, and the surface having openings beyond the pocket to reduce the weight of the apparatus, with the open end of the pocket opposite the base and having a V-shaped edge, extending towards the handle, along which the surface is corrugated.

18 Claims, 4 Drawing Sheets

Fig. 1
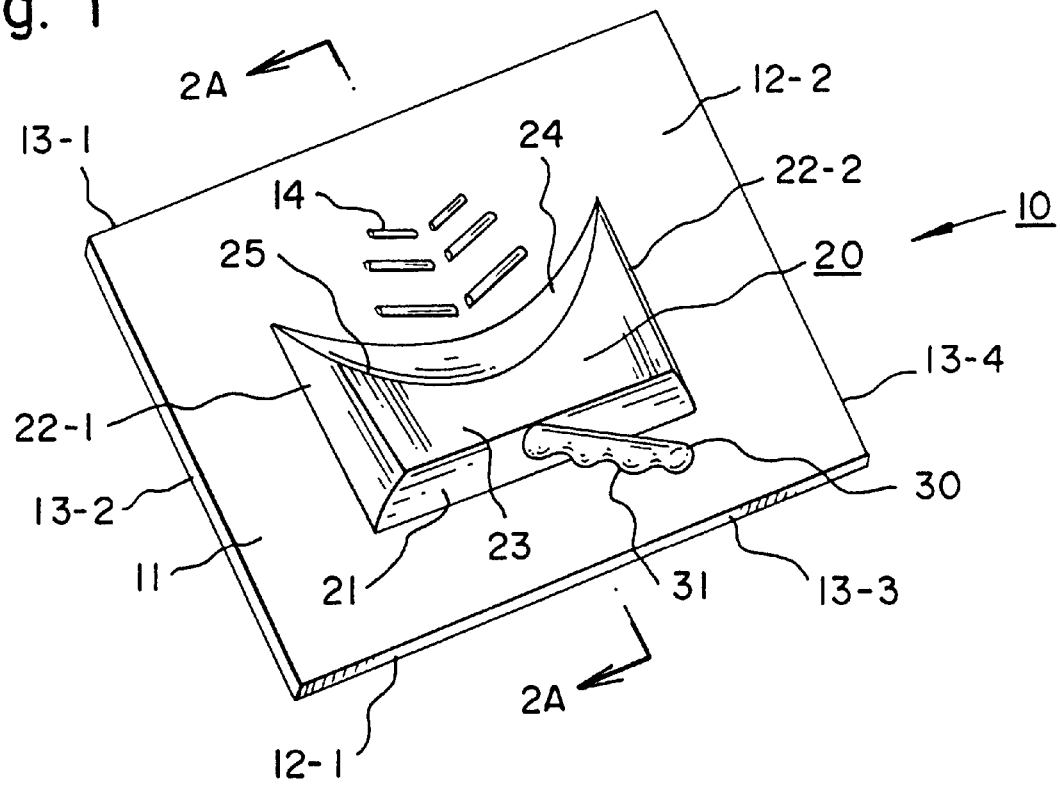
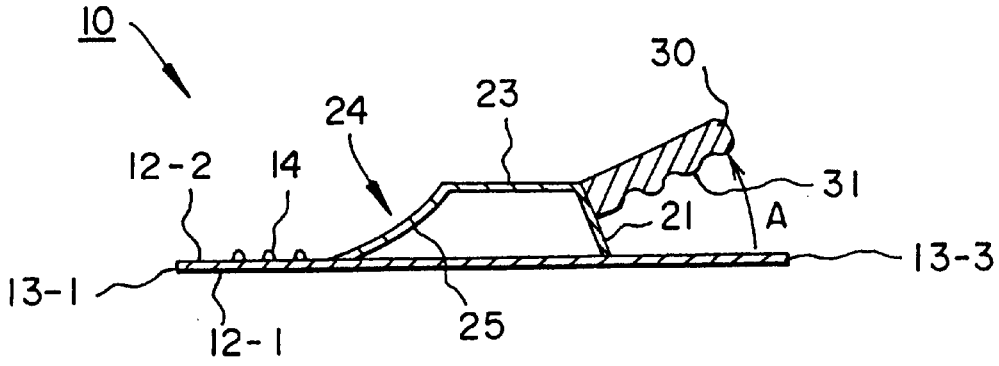
Fig. 2A

APPARATUS FOR TRIMMING OF EDGES

BACKGROUND OF THE INVENTION

This invention relates to the treatment of edges, and more particularly, to the trimming of edges with fluids, such paints.

In the trimming of edges, such those at the intersections of surfaces to be repaired or painted, it is common practice to shield one surface at the edge while the intersecting surface is being treated. For example, if the intersecting surfaces are to painted with different colors, one surface is shielded while the surface is painted with one color, following which the painted surface is shielded, and the other surface is painted with a different color. The shield can be a movable, elongated member that is positioned against the edge formed by the intersecting surfaces, or a strip of removable tape that is positioned at the edge and extends along the adjoining portion of the surface being shielded.

Both of these methods can be cumbersome and difficult. Where an elongated member is used in paint trimming, a brush is loaded with paint from a nearby container and moved along the surface to be painted at the protected edge.

This procedure involves moving the brush from the paint can to the protected edge. This can result in spillage during movement from the can to the edge and can be inconvenient when the can needs to be positioned on a ladder.

Where a protective strip is employed, there is the disadvantage of need to use a fresh strip for each change in position, and there is still the chance of spillage as the paint brush is moved from the paint container to the edge being trimmed.

Accordingly, it is an object of the invention to facilitate the trimming of edges, particularly where the edges are to be trimmed with paint.

Another object of the invention is to avoid the difficulties that can occur with the movement of the edging instrument, such as a paint brush, from the container with the material to be applied. A related object is to reduce the incidence of paint spills when moving a paint-loaded brush from a paint can to a wall surface being trimmed.

SUMMARY OF THE INVENTION

In accomplishing the foregoing and related objects the invention provides for facilitating the trimming of edges by a multi-sided member having a surface with a reservoir thereon and including means connected to the surface of the multi-sided member for the gripping thereof by an auxiliary agency, such as the hand of a user.

In accordance with one aspect of the invention means for gripping is a handle that extends from the reservoir and is displaced from the surface of the multi-sided member. The handle can extend at an acute angle above the surface.

In accordance with another aspect of the invention, the member has at least two sides which are perpendicular to one another. Where the surface of the member has a quadrilateral boundary, this can allow the member to be positioned, without turning, at longitudinally and laterally opposed edges.

In accordance with a further aspect of the invention, the reservoir forms a open pocket affixed to the surface. The pocket can have a base to which the handle is connected, and the surface can have openings beyond the pocket to reduce the weight of the apparatus. The open end of the pocket, opposite the base, can have a V-shaped edge which extends towards the handle, with the surface corrugated along the V-shaped edge.

In a method of the invention for facilitating the trimming of edges, the steps include (a) gripping a multi-sided member by means extending to a surface thereof and having a reservoir; and (b) positioning one side of the multi-sided member against an edge to be trimmed, with the member having an exposed reservoir on a surface thereof.

The method can further include the steps of: (a) filling the reservoir with fluid, such as paint, and (b) transferring the fluid from the reservoir to the edge to be trimmed, for example, using a paint brush.

The method also includes the step of positioning another side of the member against another edge to be trimmed. Where the surface of the member is flat, it can be positioned against a complementary flat surface, such as that of a wall, extending from the edge to be trimmed.

In a method of the invention for fabricating apparatus to facilitate the trimming of edges, the steps include (a) providing a multi-sided member having opposed surfaces; and (b) mounting a reservoir on one of the surfaces. The method further includes the step of mounting means on the one surface for the gripping thereof by an auxiliary agency, such as the hand of a user.

The method further includes the step of attaching to the reservoir the means for gripping, and wherein the reservoir has an entrance, further including the step of corrugating the one surface at the entrance to the reservoir.

The member can be fabricated from plastic and be apertured around the fluid reservoir to lighten the member and facilitate the positioning thereof.

DESCRIPTION OF THE DRAWINGS

Other aspects of the invention will become apparent after considering several illustrative embodiments taken in conjunction with the drawings in which:

FIG. 1 is a perspective view of an edge trimmer in accordance with the invention;

FIG. 2A is a side sectional view of the edge trimmer taken along the lines 2A—2A of FIG. 1;

DETAILED DESCRIPTION

Figure 2B:
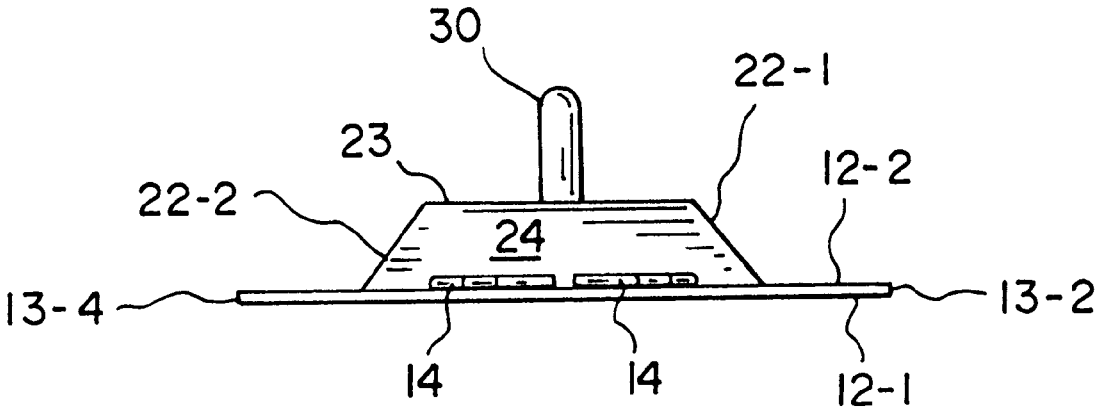
FIG. 2B is a front sectional view of the edge trimmer taken along the lines 2B—2B of FIG. 1.

With reference to the drawings, FIG. 1 shows an edge trimmer 10 of the invention taking the form of a rectangular panel 11 having opposed, flat surfaces 12-1 and 12-2 bounded by sides 13-1 through 13-4.

A reservoir 20 for fluid is affixed to the surface 12-2 and includes a base 21 with sides 22-1 and 22-2 joined by a cover 23 defining an opening 24. The side 25 along the opening 24 from the side 22-1 to the side 22-2 is indented, illustratively V-shaped, and the surface 12-2 opposite the opening bears corrugations 14.

Extending from the base 21 of the reservoir is a handle 30, which, as shown in FIG. 2A, is displaced away from the surface 12-2 at an angle A. It will be understood that other attachments and dispositions of the handle 30 may be made. For convenience in holding the edge trimmer 10, the handle 30 bears finger indentations 31.

Both the panel 11 and the reservoir 20 are made of suitable materials, such as plastic, and adhered to one another in convenient fashion. In an illustrative embodiment of the invention, trimmer 10 is square measuring 17 inches by 17 inches, and the reservoir is centered on the surface 12-2 and positioned about 8 inches from the side 13-4 of the panel 11. The reservoir 20 has a height from the surface 122 of about 1 and ¾ inches.

Figure 3:
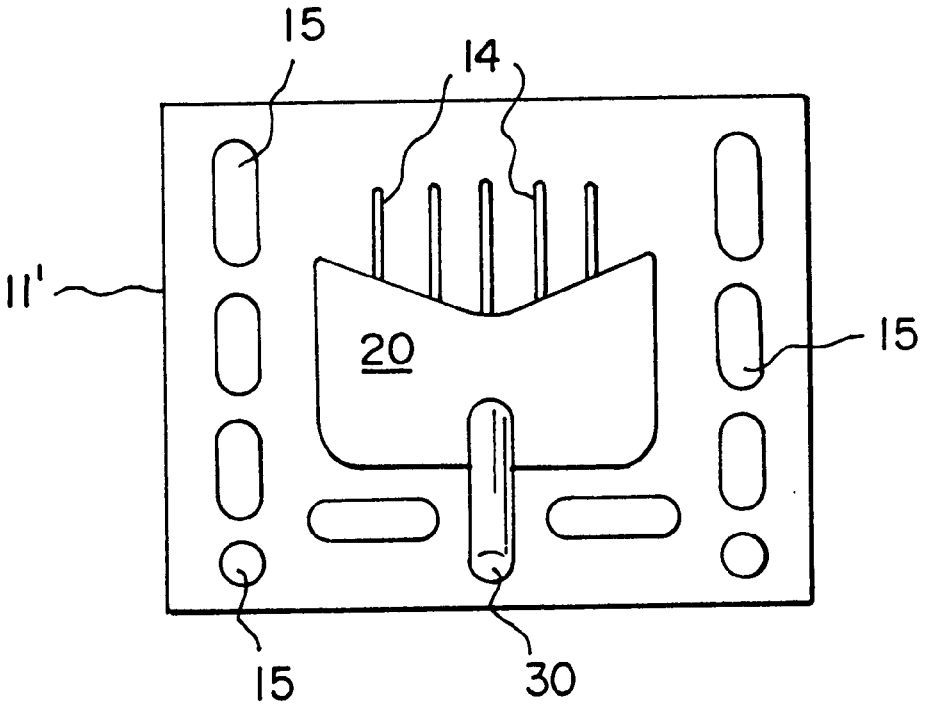
FIG. 3 is a top view of an alternative edge trimmer in accordance with the invention.

In the alternate embodiment of FIG. 3 the panel 11' has apertures 15 disposed about the reservoir 20 in order to reduce the weight of the trimmer and make it easier to use.

Figure 4A:
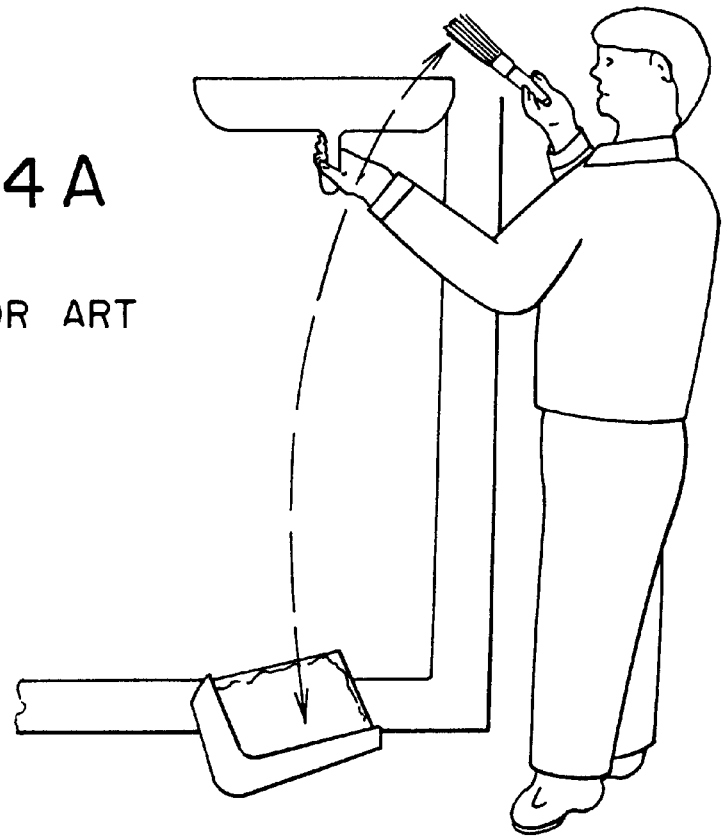
Fig. 4A PRIOR ART
FIGS. 4A and 4B are perspective views showing an illustrative use of the prior art in the trimming of an edge at the intersection of wall surfaces by loading a paint brush from a pan and then moving the paint-loaded brush to the edge being trimmed.
Figure 4B:
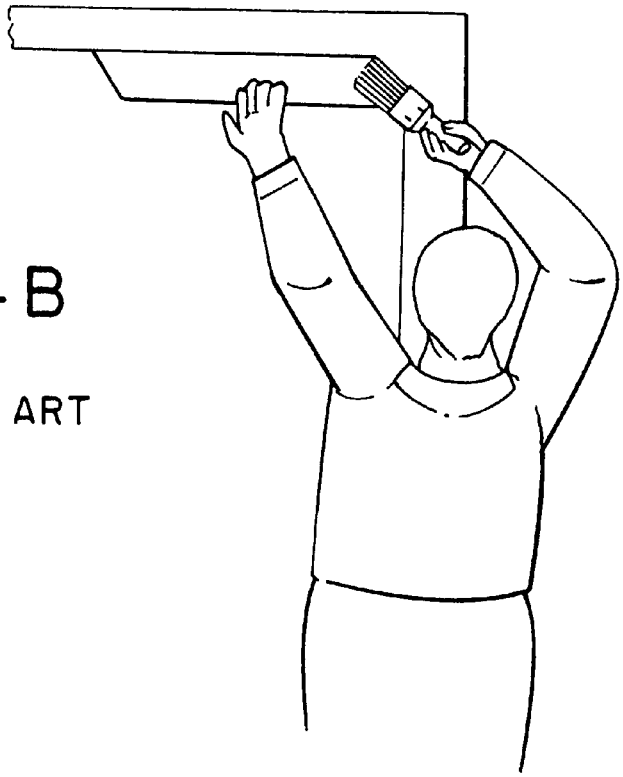
Fig. 4B PRIOR ART

In the prior art as illustrated in FIGS. 4A and 4B. it is necessary to load a paint brush from a pan and then moving the paint-loaded brush to the edge being trimmed.

Figure 5A:
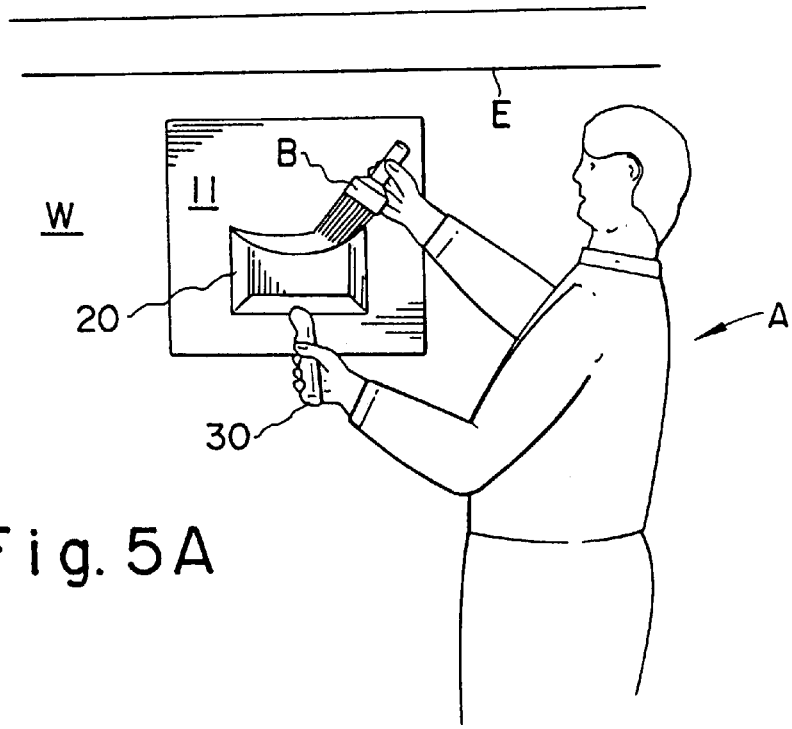
FIGS. 5A and 5B are perspective view showing an illustrative use of the invention in the trimming of an edge at the intersection of wall surfaces by loading a paint brush from the reservoir of the edge trimmer and transferring paint to the edge using the paint loaded brush.
Figure 5B:
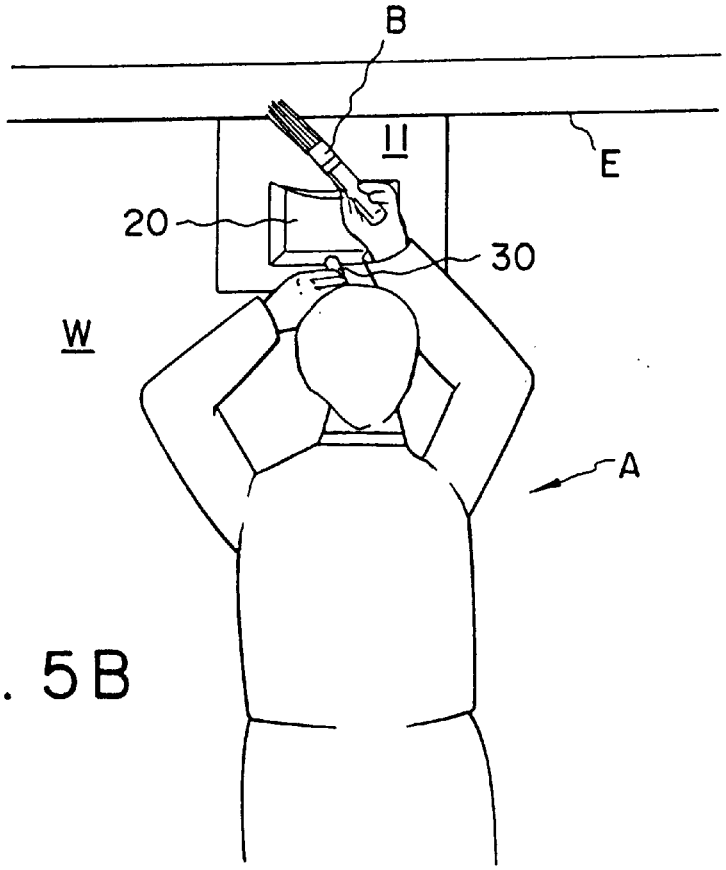

By contrast with the invention, as illustrated in FIGS. 5A and 5B an edge at the intersection of wall surfaces is trimmed by loading a paint brush from the reservoir of the edge trimmer and transferring paint to the edge using the paint loaded brush.

As indicated in FIG. 5B, a using agency, i.e., user A, taking the form of a person, after placing paint or other fluid in the reservoir 20, grabs the handle 30 is his left hand and positions the panel 11 against the illustrative wall W near an edge E that is to be trimmed. A brush B held in the right hand of the user A is inserted into the reservoir 20 to load it with pant and moved to the edge E which can then be trimmed without applying paint to the wall W.

Other uses and adaptations of the invention, including adjustments and accessories with respect to the hand grips and the arcuate retainers, will be readily apparent to those of ordinary skill in the art.

What is claimed is:

1. Apparatus for facilitating the trimming of edges, comprising a multi-sided member having a base and a surface with a reservoir thereon and means on said surface of said member for the gripping thereof;

wherein said reservoir forms an opened pocket affixed to said surface and an open end of said pocket is opposite said base and has a V-shape and said surface is corrugated along said edge.

2. Apparatus as defined in claim 1, wherein said multi-sided member is quadrilateral having a surface with a reservoir therewithin and said means on said surface of said member for the gripping thereof is hand-held.

3. Apparatus as defined in claim 1 further including means on said surface, displaced from said reservoir, for extending the gripping means from said reservoir.

4. Apparatus as defined in claim 1 wherein said gripping means comprises a handle upwardly displaced from said surface.

5. Apparatus as defined in claim 4 wherein said handle extends at an acute angle above said surface.

6. Apparatus as defined in claim 1 wherein said member has at least two sides which are perpendicular to one another.

7. Apparatus as defined in claim 1 wherein the surface of said member has a perpendicular boundary;

thereby to allow said member to be positioned, without turning, at longitudinally and laterally opposed edges.

8. Apparatus as defined in claim 1, wherein (a) said multi-sided member surrounds a fluid reservoir and a handle extends therefrom; and (b) means for positioning one side of said multi-sided member against an edge to be trimmed with paint, with said reservoir exposed on a surface of said member.

9. Apparatus as defined in claim 8 further including:

(a) fluid filling said reservoir in surface contact with said member; and (b) means for transferring said fluid from said reservoir to said edge to be trimmed.

10. Apparatus as defined in claim 9 wherein said fluid is paint which is transferred from said surface contact with said member to said edge.

11. Apparatus as defined in claim 8 further including means for positioning said member from a horizontal trimming position against an edge to be trimmed vertically.

12. Apparatus as defined in claim 9 wherein said surface in contact with said member is flat and is positionable against a complementary flat surface extending from said edge.

13. Apparatus for facilitating the trimming of surfaces, comprising:

(a) multi-sided member having opposed surfaces; and (b) a reservoir mounted on one of said surfaces;

further including mounting means on said one of said surfaces for the gripping thereof;

wherein said member is fabricated from plastic and said one of said surfaces is apertured around said reservoir to lighten said member and facilitate the positioning thereof.

14. Apparatus as defined in claim 13 wherein said multi-sided member having opposed surfaces has said reservoir covering one of said surfaces.

15. Apparatus as defined in claim 14 further including mounting means angularly positioned to said one of said surfaces for the gripping thereof by hand.

16. Apparatus as defined in claim 15 wherein said reservoir has sides parallel to an entrance and said one of said surfaces is corrugated parallel to said side at said entrance.

17. Apparatus as defined in claim 13 for facilitating the fluid-trimming of edges, wherein:

(a) said multi-sided member has a fluid reservoir and said means for gripping extends therefrom; and including (b) means for positioning one side of said multi-sided member against an edge to be trimmed with fluid and another side of said multi-sided member against another edge to be trimmed.

18. Apparatus as defined in claim 17 further including means for attaching to said reservoir said means for gripping.

* * * * *